US007846380B2

(12) United States Patent
Shimura

(10) Patent No.: US 7,846,380 B2
(45) **Date of Patent: *Dec. 7, 2010**

(54) METAL POWDER PRODUCTION APPARATUS AND METAL POWDER

(75) Inventor: Tokihiro Shimura, Aomori (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/504,729

(22) Filed: Jul. 17, 2009

(65) Prior Publication Data

US 2009/0274785 A1 Nov. 5, 2009

Related U.S. Application Data

(63) Continuation of application No. 11/708,121, filed on Feb. 16, 2007, now Pat. No. 7,578,961.

(30) Foreign Application Priority Data

Feb. 16, 2006 (JP) ..... 2006-039903
Dec. 7, 2006 (JP) ..... 2006-331201

(51) Int. Cl.
*C21C 1/00* (2006.01)

(52) U.S. Cl. ..... 266/202; 266/236

(58) Field of Classification Search ..... 266/202, 266/236

See application file for complete search history.

(56) References Cited

U.S. PATENT DOCUMENTS 4,624,409 A 11/1986 Takeda et al.
5,366,204 A 11/1994 Gigliotti et al.
7,132,019 B2 11/2006 Koshiba et al.
7,368,078 B2 5/2008 Nakabayashi et al.
7,578,961 B2 * 8/2009 Shimura ..... 266/202

FOREIGN PATENT DOCUMENTS

| | | |
|---|---|---|
| JP | B-3-55522 | 8/1991 |
| JP | A-2003-113406 | 4/2003 |
| JP | A-2005-307291 | 11/2005 |
| JP | A-2006-241562 | 9/2006 |

* cited by examiner

*Primary Examiner*—Scott Kastler
(74) *Attorney, Agent, or Firm*—Harness, Dickey & Pierce, P.L.C.

(57) ABSTRACT

A metal powder production apparatus is capable of efficiently producing fine metal powder with a uniform particle size. The metal powder produced by the apparatus has an increased quality. The apparatus (atomizer) makes use of an atomizing method to pulverize molten metal into metal powder. The apparatus includes a supply part (tundish) for supplying the molten metal, a nozzle provided below the supply part, a tubular member provided between the supply part and the nozzle. The tubular member is constructed to ensure that the molten metal ejected from an ejection port passes through a bore of the tubular member and then makes contact with a fluid jet. Further, the tubular member has a top end air-tightly connected to the supply part and a bottom end lying around the midway of a first flow path through which the molten metal passes.

9 Claims, 7 Drawing Sheets

METAL POWDER PRODUCTION APPARATUS AND METAL POWDER

CROSS-REFERENCE TO RELATED APPLICATION

This application is a continuation of U.S. patent application Ser. No. 11/708,121 filed on Feb. 16, 2007 now U.S. Pat. No. 7,578,961 which claims priority to Japanese Patent Applications No. 2006-039903 filed on Feb. 16, 2006 and No. 2006-331201 filed on Dec. 7, 2006, all of which are hereby expressly incorporated by reference herein in their entireties.

BACKGROUND

1. Technical Field

The present invention relates to a metal powder production apparatus and metal powder.

2. Related Art

Conventionally, a metal powder production apparatus (atomizer) that pulverizes molten metal into metal powder by an atomizing method has been used in producing metal powder. Examples of the metal powder production apparatus known in the art include a molten metal atomizing and pulverizing apparatus disclosed in JP-B-3-55522.

The molten metal atomizing and pulverizing apparatus is provided with an ejection port from which molten bath (molten metal) is ejected in a downward direction and a nozzle having a flow path through which the molten bath ejected from the ejection port passes and a slit opened into the flow path. Water is injected from the slit of the nozzle.

The apparatus of prior art mentioned above is designed to produce metal powder by bringing the molten bath passing through the flow path into collision with the water injected from the slit to thereby disperse the molten bath in the form of a multiplicity of fine liquid droplets and then allowing the multiplicity of fine liquid droplets to be cooled and solidified.

The molten bath ejected from the ejection port falls freely through the flow path and makes contact with the water. However, the route of passage of the molten bath varies with a multiple number of factors such as a flow velocity of the water, a shape of the nozzle and the like, which in turn changes the position in which the molten bath makes contact with the water.

This poses a problem in that the molten bath is changed in its dispersion, cooling and solidification conditions, thus giving rise to a variation in grain diameter or particle size distribution of the metal powder produced.

Furthermore, since the ambient air is introduced into the depressurized flow path, there is produced an air stream in the vicinity of the flow path. Upon making contact with the air, however, the molten bath may be solidified by temperature reduction or may be degenerated or degraded by oxidation, thus leaving a possibility that the resultant metal powder shows reduction in quality. In particular, this problem becomes conspicuous in the case where the molten metal contains highly active metal elements such as Ti and Al.

SUMMARY

Accordingly, it is an object of the present invention to provide a metal powder production apparatus capable of efficiently producing fine metal powder with a uniform particle size and also to provide metal powder of an increased quality produced by the metal powder production apparatus.

A first aspect of the invention is directed to a metal powder production apparatus. The metal powder production apparatus comprises a supply part for supplying molten metal and a nozzle provided below the supply part. The nozzle includes a flow path defined by an inner circumferential surface of the nozzle through which the molten metal supplied from the supply part can pass and having a bottom end portion and an orifice opened toward the bottom end portion of the flow path for injecting fluid into the flow path.

The molten metal can be dispersed and turned to a multiplicity of fine liquid droplets by bringing the molten metal passing through the flow path into contact with the fluid injected from the orifice of the nozzle so that the multiplicity of fine liquid droplets are cooled and solidified to thereby produce metal powder.

The metal powder production apparatus further comprises a tubular member provided between the supply part and the flow path of the nozzle, the tubular member having a top end, a bottom end and a bore through which the molten metal supplied from the supply part passes to make contact with the fluid.

According to the above metal powder production apparatus, since the tubular member is provided between the supply part and the flow path, the molten metal can be led to an appropriate target position of the flow path by the tubular member. Therefore, this metal powder production apparatus is capable of efficiently producing fine metal powder with a uniform particle size.

In the above metal powder production apparatus, it is preferred that the tubular member is arranged such that the bottom end of the tubular member lies around the midway of the flow path.

This ensures that the molten metal is supplied through the inside of the tubular member up to near a section where depressurization occurs most severely. As a consequence, it is possible to reliably prevent or suppress the adverse effects which would be caused by contact of the molten metal with the air.

In the above metal powder production apparatus, it is preferred that the flow path has a portion whose inner diameter defined by the inner circumferential surface of the nozzle is continuously decreased in a downward direction.

This helps to make smooth the inner circumferential surface of the nozzle. The air sucked up into the flow path is accelerated along the inner circumferential surface thereof without any hitch, thereby reducing the pressure in the flow path. This makes it possible to finely disperse the molten metal and to obtain fine-sized liquid droplets.

In the above metal powder production apparatus, it is preferred that the flow path has the smallest inner diameter portion and the tubular member is arranged such that the bottom end of the tubular member lies near the smallest inner diameter portion of the flow path.

This ensures that the flow velocity of the air sucked up into the flow path becomes fastest near the bottom end of the tubular member, for the reason of which the pressure is further reduced in the vicinity of the bottom end. This makes it possible to further finely disperse the molten metal and to obtain particularly fine liquid droplets.

In the above metal powder production apparatus, it is preferred that the top end of the tubular member makes contact with the supply part.

This makes it possible to cut off the air which would otherwise be sucked up and introduced into the tubular member at the top end thereof by the falling molten metal. As a result, it becomes possible to suppress the adverse effects (such as disturbance of the flowing route, temperature reduction and oxidation of the molten metal) which would be caused by contact of the molten metal with the air.

In the above metal powder production apparatus, it is preferred that the top end of the tubular member air-tightly connects to the supply part.

This makes it possible to more reliably prevent the air from being introduced into the tubular member at the top end of the latter. Furthermore, the bottom end portion of the tubular member is depressurized by the stream of the air flowing below the tubular member. As a result, the molten metal is ejected in such a manner that it is sucked out of an opening of the tubular member, thereby preventing a solidified material from being adhered to the periphery of the opening.

In the above metal powder production apparatus, it is preferred that the bore of the tubular member has a cross-sectional area of 1 to 400 $mm^2$.

Use of the tubular member having such a range of dimensions enables the present metal powder production apparatus to efficiently produce extremely fine metal powder with a uniform particle size.

In the above metal powder production apparatus, it is preferred that the tubular member has a generally cylindrical shape.

This assures that, in the case where the liquid droplets fall down from the bottom end surface (bottom end portion) of the tubular member for instance, they are distributed in a horizontal direction so as to make contact with a fluid jet of a generally conical shape without any unevenness. As a result, the fluid jet enables the liquid droplets to be uniformly dispersed and cooled as a whole, thus producing metal powder with a uniform particle size. This also helps to prevent a possibility that the stream of the air introduced into the flow path is unintentionally disturbed by the tubular member and thus the falling route of the molten metal is changed.

In the above metal powder production apparatus, it is preferred that the tubular member is provided with a split means for substantially uniformly splitting the molten metal, which has passed the bore of the tubular member, in a divergent manner.

Use of the split means enables the liquid droplets to evenly fall down over the entirety of the flow path, thereby allowing the liquid droplets to make substantially uniform contact with a conical fluid jet and to be cooled and solidified with high cooling efficiency. This makes it possible to obtain homogeneous metal powder in a more reliable manner.

In the above metal powder production apparatus, it is preferred that the tubular member has a bottom end surface and the split means comprises at least one protrusion provided along the circumferential direction of the bottom end surface of the tubular member.

Such (a) protrusion(s) can be readily used as the split means that serves to substantially uniformly split the molten metal, which has passed the bore of the tubular member, along the circumferential direction of the bottom end surface of the tubular member.

In the above metal powder production apparatus, it is preferred that the at least one protrusion includes a plurality of protrusions.

This helps to remove a likelihood of the liquid droplets being concentrated on a local area of the bottom end surface (bottom end portion), even if the axis of the tubular member remains slightly inclined with respect to a vertical direction for example. This allows the liquid droplets to uniformly fall down over the entirety of the flow path.

In the above metal powder production apparatus, it is preferred that the plurality of protrusions are arranged substantially at equal intervals along the circumferential direction of the bottom end surface of the tubular member.

This makes it easy to form the liquid droplets substantially uniformly along the circumferential direction of the tubular member.

In the above metal powder production apparatus, it is preferred that the at least one protrusion includes one protrusion having an annular shape.

This enables the protrusion to serve as the split means capable of uniformly splitting the molten metal.

In the above metal powder production apparatus, it is preferred that the at least one protrusion has a sharp bottom end.

This helps to reduce the contact area between the liquid droplets and the tubular member, thereby allowing the liquid droplets to be rapidly separated from the tubular member. As a result, it is possible to further shorten the time for which the liquid droplets stay on the surface of the tubular member, i.e., the time for which the liquid droplets make contact with the air.

In the above metal powder production apparatus, it is preferred that the tubular member is of a bottom-walled tubular shape having a bottom wall and the split means comprises a plurality of apertures formed in the bottom wall so as to be uniformly distributed in the bottom wall.

This ensures that the molten metal is split into metal streams of a small and uniform size prior to being subjected to a primary breakup, which makes it possible to obtain finer liquid droplets of a narrow particle size distribution in the primary breakup.

In the above metal powder production apparatus, it is preferred that the tubular member is made of a ceramics material.

Use of the ceramics material is preferred because it is particularly high in heat resistance and less likely to undergo chemical changes such as oxidation. Furthermore, the ceramics material shows a relatively high thermal insulation property (a relatively low heat conductivity), which provides an advantage of suppressing the temperature reduction of the molten metal.

In the above metal powder production apparatus, it is preferred that the fluid is of a liquid form.

The liquid fluid has a specific gravity and a heat capacity greater than those of gas fluid and is therefore capable of making the molten metal finer and efficiently cooling the same within a short period of time when contacted with the molten metal (in the secondary breakup process). Furthermore, the liquid fluid tends to suck up a larger quantity of air, which means that the liquid fluid can reduce the pressure (barometric pressure) of the flow path to a lower level and further facilitate pulverization of the molten metal in the primary breakup process.

In the above metal powder production apparatus, it is preferred that the molten metal contains at least one of Ti and Al.

These elements are highly active and it is a conventional knowledge that the molten metal containing these elements has a difficulty in pulverization because of its tendency to be easily oxidized into an oxide film through short contact with the air. The present metal powder production apparatus is able to easily powderize even such kind of molten metal.

In the above metal powder production apparatus, it is preferred that the nozzle includes a first member and a second member arranged below the first member with a space left therebetween to form the orifice, the first member having a recess portion which is formed in an annular shape corresponding to the portion of the flow path along the circumferential direction thereof and by which an air stream, which is produced in the flow path under the action of the fluid injected from the orifice of the nozzle, is disturbed and directed toward the tubular member.

This ensures that the air stream directed toward the tubular member flows downwardly along the outer circumferential surface of the tubular member. Accordingly, in the bottom end portion of the tubular member, the air stream passes through a region closer to the tubular member, thereby further promoting the pressure reduction in the vicinity of the bottom end portion of the tubular member.

A second aspect of the invention is also directed to a metal powder produced by the metal powder production apparatus set forth above.

This makes it possible to obtain metal powder of a high quality.

In the above metal powder, it is preferred that the metal powder has an average particle size in the range of 1 to 20 μm.

The above metal powder production apparatus can be advantageously used in producing such fine metal powder.

The above and other objects, features and advantages of the present invention will become apparent from the following description of preferred embodiments given in conjunction with the accompanying drawings.

DESCRIPTION OF EXEMPLARY EMBODIMENTS

Hereinafter, a metal powder production apparatus and metal powder in accordance with the present invention will be described in detail with reference to the accompanying drawings.

First Embodiment

First of all, description will be made on a metal powder production apparatus in accordance with a first embodiment of the present invention.

Figure 1:
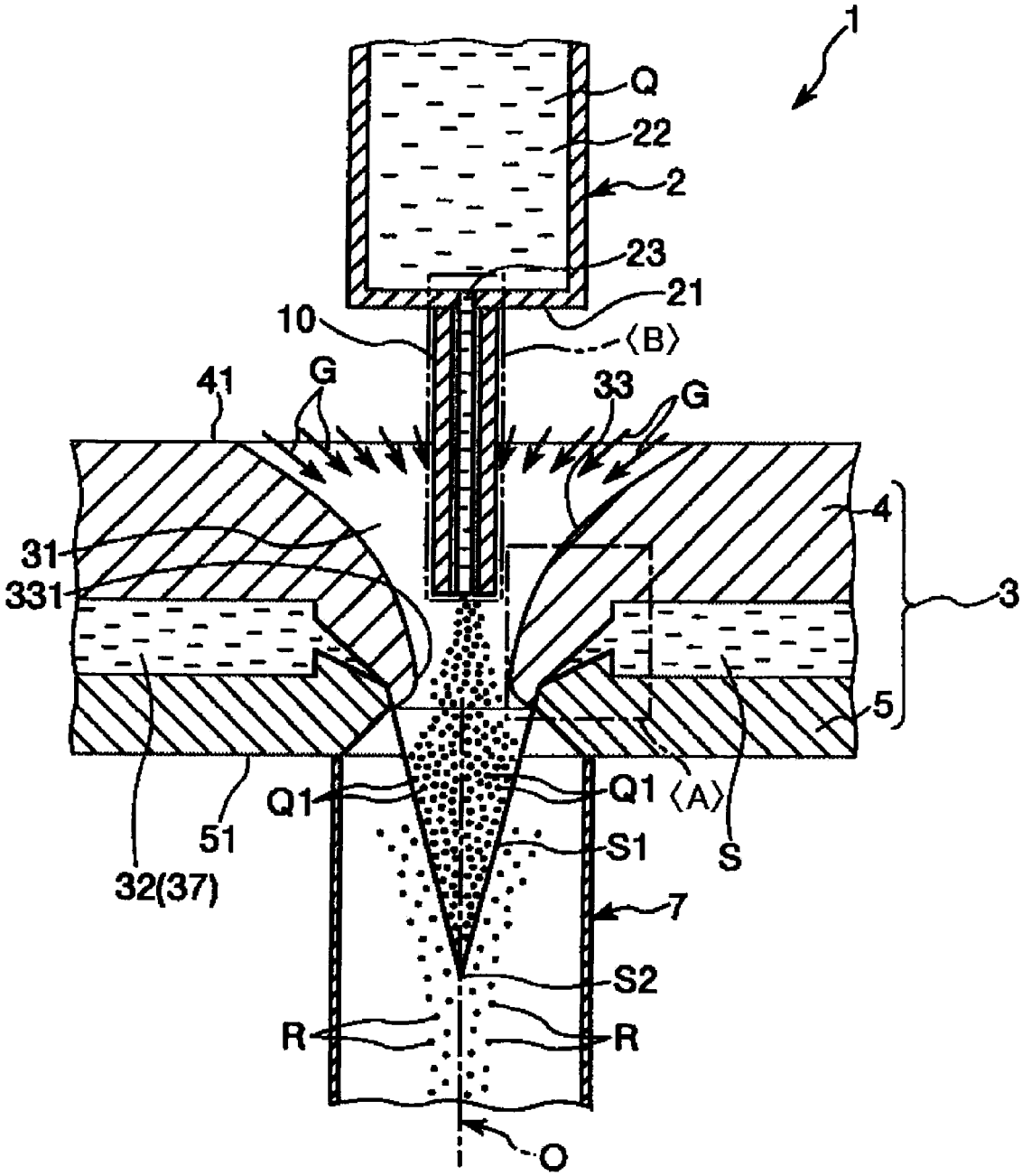
FIG. 1 is a schematic view (vertical sectional view) showing a metal powder production apparatus in accordance with a first embodiment of the present invention.
Figure 2:
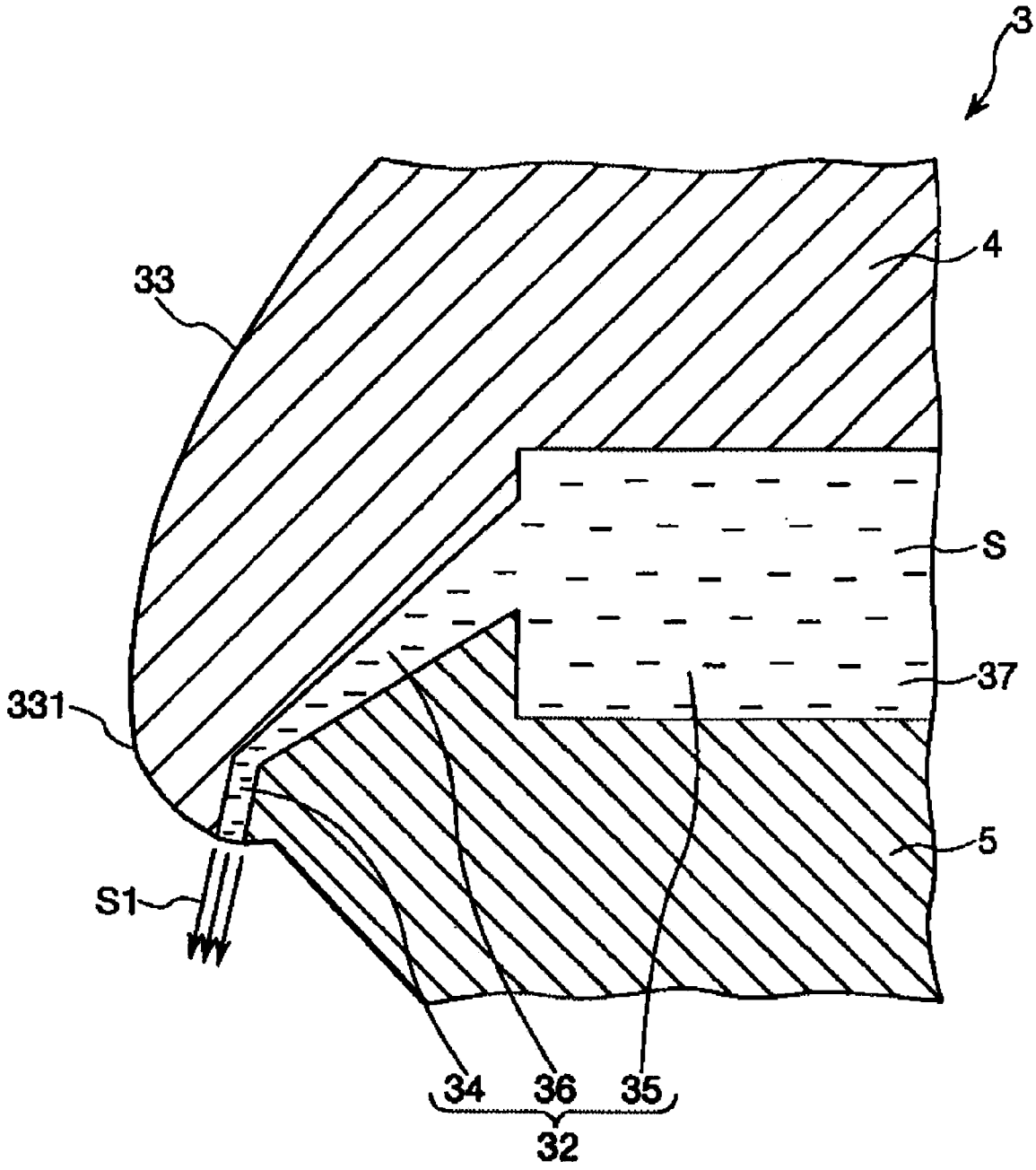
FIG. 2 is an enlarged detail view (schematic view) of a region <A> enclosed by a single-dotted chain line in FIG. 1.
Figure 3:
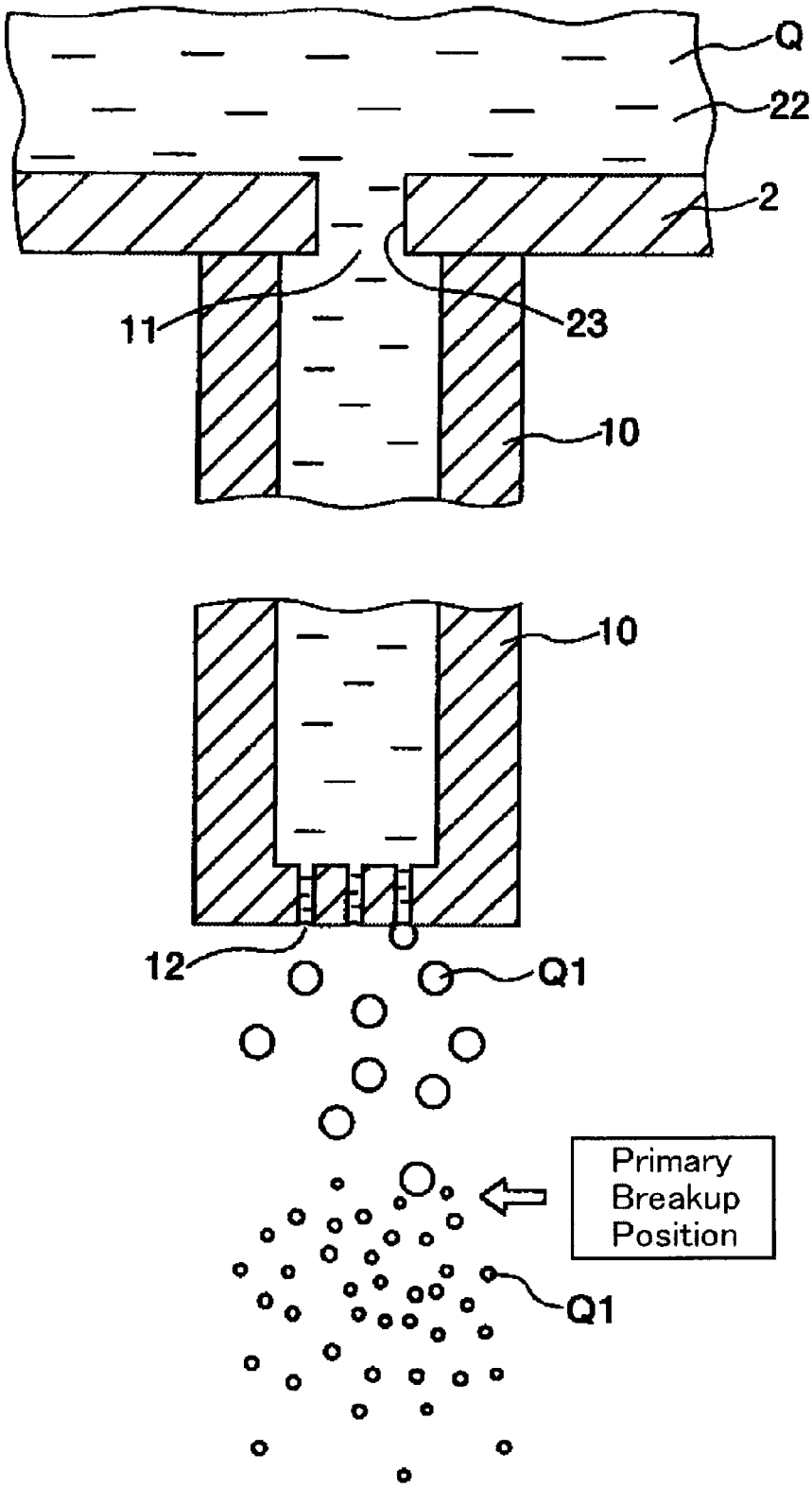
FIG. 3 is an enlarged detail view (schematic view) of a region <B> enclosed by a double-dotted chain line in FIG. 1.

FIG. 1 is a schematic view (vertical sectional view) showing a metal powder production apparatus in accordance with a first embodiment of the present invention, FIG. 2 is an enlarged detail view (schematic view) of a region <A> enclosed by a single-dotted chain line in FIG. 1, and FIG. 3 is an enlarged detail view (schematic view) of a region <B> enclosed by a double-dotted chain line in FIG. 1.

In the following description, the upper side in FIGS. 1 to 3 will be referred to as "top" or "upper" and the lower side will be referred to as "bottom" or "lower", only for the sake of better understanding.

The metal powder production apparatus (atomizer) 1 shown in FIG. 1 is an apparatus that makes use of an atomizing method to pulverize molten metal Q into metal powder R. The metal powder production apparatus 1 includes a supply part (tundish) 2 for supplying the molten metal Q, a nozzle 3 provided below the supply part 2, a tubular member 10 provided between the supply part 2 and the nozzle 3.

Now, description will be given to the configuration of individual parts.

As shown in FIG. 1, the supply part 2 has a bottom-walled tubular portion. In an internal space (cavity portion) 22 of the supply part 2, there is temporarily stored the molten metal Q obtained by melting a raw material of the metal powder to be produced.

Furthermore, an ejection port 23 is formed at the center of a bottom portion 21 of the supply part 2. The molten metal Q in the internal space 22 falls freely in a downward direction and is ejected from the ejection port 23.

The nozzle 3 is arranged below the supply part 2. The nozzle 3 is provided with a first flow path 31 through which the molten metal Q supplied (ejected) from the supply part 2 passes and a second flow path 32 through which water S supplied from a water source (not shown) for supplying fluid (water in the present embodiment) passes.

The first flow path 31 has a circular cross-section and extends in a vertical direction at the center of the nozzle 3. The flow path 31 is defined by an inner circumferential surface of the nozzle 3.

The nozzle 3 has a gradually reducing inner diameter portion 33 of a convergent shape whose inner diameter is gradually decreased from a top end surface 41 of the nozzle 3 toward the bottom thereof. In other words, the first flow path 31 has a portion whose inner diameter defined by the inner circumferential surface of the nozzle 3 is continuously decreased in a downward direction. Thus, the air (gas) G subsisting above the nozzle 3 is sucked up into the gradually reducing inner diameter portion 33 by a stream of water S injected from an orifice 34, which will be described later.

The air G thus introduced shows a greatest flow velocity near a smallest inner diameter section 331 of the gradually reducing inner diameter portion 33 (first flow path 31), i.e., near a section in which the orifice 34 is opened. As the air G flows in this manner, the pressure (barometric pressure) in the first flow path 31 is gradually reduced from the top toward the smallest inner diameter section 331.

If the pressure around the molten metal Q is reduced as the latter passes through the first flow path 31 kept in such a depressurized state and if the degree of depressurization in the surroundings overwhelms the force of aggregation, the molten metal Q is dispersed (subjected to primary breakup) and thus turned to a multiplicity of fine liquid droplets Q1.

The position in the first flow path 31 where the molten metal is subjected to the primary breakup by reduction of the surrounding pressure will be referred to as "primary breakup position".

Although the vicinity of the smallest inner diameter section 331 of the gradually reducing inner diameter portion 33 has been described as the most severely depressurized region, it should be appreciated that the exact position of the most severely depressurized region is not limited to the one of the present embodiment but may be changed depending on the shape, angle or the like of the gradually reducing inner diameter portion 33, the orifice 34 and so forth.

In the present embodiment, the inner diameter of the gradually reducing inner diameter portion 33 is continuously reduced in the downward direction. Thus, the gradually reducing inner diameter portion 33 has a smooth inner circumferential surface. The air G sucked up into the gradually reducing inner diameter portion 33 is accelerated along the inner circumferential surface thereof without any hitch, thereby reducing the pressure in the first flow path 31.

Particularly, the flow velocity of the air G becomes fastest near the smallest inner diameter section 331 of the gradually reducing inner diameter portion 33 in the first flow path 31, for the reason of which the pressure is further reduced in the vicinity of the smallest inner diameter section 331. This makes it possible to finely disperse the molten metal Q and to obtain fine-sized liquid droplets Q1.

As illustrated in FIG. 2, the second flow path 32 is formed of an orifice 34 opened toward a bottom end portion (the vicinity of the smallest inner diameter section 331) of the first flow path 31, a retention portion 35 for temporarily retaining the water S, and an introduction path 36 through which the water S is introduced from the retention portion 35 into the orifice 34.

The retention portion 35 is connected to the water source to receive the water S therefrom. The retention portion 35 communicates with the orifice 34 through the introduction path 36.

The introduction path 36 is a region whose vertical cross-section is of a wedge-like shape. This makes it possible to gradually increase the flow velocity of the water S flowing into the introduction path 36 from the retention portion 35 and, hence, to stably inject the water S with an increased flow velocity from the orifice 34.

The orifice 34 is a region in which the water S that has passed the retention portion 35 and the introduction path 36 in sequence is injected or spouted into the first flow path 31.

The orifice 34 is opened in the form of a slit over the entire inner circumferential surface of the nozzle 3. Furthermore, the orifice 34 is opened in an inclined direction with respect to a center axis O of the first flow path 31.

By virtue of the orifice 34 formed in this manner, the water S is injected as a fluid jet S1 of a generally conical contour with an apex S2 thereof lying on the lower side (see FIG. 1). The molten metal Q is brought into contact with the fluid jet S1 and is dispersed (subjected to secondary breakup) into a further fine shape.

At this time, the liquid droplets Q1 are cooled and solidified to produce metal powder R. The metal powder R thus produced is received in a container (not shown) arranged below the metal powder production apparatus 1.

As shown in FIGS. 1 and 2, the nozzle 3 in which the first flow path 31 and the second flow path 32 are formed includes a first member 4 of a disk-like shape (ring-like shape) and a second member 5 of a disk-like shape (ring-like shape) arranged concentrically with the first member 4. The second member 5 is arranged below the first member 4 with a space 37 left therebetween.

The orifice 34, the introduction path 36 and the retention portion 35 are respectively defined by the first member 4 and the second member 5 arranged in this way. That is to say, the second flow path 32 is provided by the space 37 formed between the first member 4 and the second member 5.

Examples of a constituent material of the first member 4 and the second member 5 include, but are not particularly limited to, a variety of metallic materials. In particular, use of stainless steel is preferred.

As shown in FIG. 1, a cover 7 formed of a tubular body is fixedly secured to a bottom end surface 51 of the second member 5. The cover 7 is concentric with the first flow path 31. Use of the cover 7 makes it possible to prevent the metal powder R from flying apart as they fall down, whereby the metal powder R can be reliably received the container.

It is preferred that the cover 7 is air-tightly connected to the bottom end surface 51 of the second member 5. This makes it possible to prevent the external air from flowing into the cover 7. As a consequence, it is possible to reliably prevent the liquid droplets Q1 from making contact with the external air and suffering from oxidative deterioration which would otherwise occur when the liquid droplets Q1 undergo the secondary breakup.

Under the action of the fluid jet S1, the inside of the cover 7 is kept in a depressurized condition. This further reduces the pressure within the first flow path 31 communicating with the inside of the cover 7. As a result, the molten metal Q is more finely split up during the primary breakup, which makes it possible to obtain even finer liquid droplets Q1 and, eventually, even finer metal powder R.

From this point of view, the inner diameter of the cover 7 is preferably about 1 to 4 times, and more preferably about 1.5 to 3 times, as great as the ring diameter of the orifice 34 (the diameter of the annular orifice 34). This makes it possible to sufficiently reduce the pressure within the cover 7, while fully cooling the liquid droplets Q1.

If the inner diameter of the cover 7 is smaller than the lower limit value noted above, there is a possibility that the liquid droplets formed by splitting the liquid droplets Q1 during the secondary breakup may not be sufficiently cooled. Thus, the metal powder R obtained may have an abnormal shape.

On the other hand, if the inner diameter of the cover 7 is greater than the upper limit value noted above, there may be a case that the pressure within the cover 7 cannot be sufficiently reduced. This may make it impossible to further depressurize the inside of the first flow path 31 communicating with the inside of the cover 7.

Now, the prior art metal powder production apparatus (atomizer) was of such a construction that the molten metal ejected from an ejection port of a supply part falls freely in the air through a flow path and makes contact with a fluid jet.

As set forth above, an air stream is produced in the flow path under the action of the fluid jet. Thus, the falling route of the free-falling molten metal is fluctuated by the air stream. This means that the molten metal does not follow a constant passage route when it passes the primary breakup position.

As a consequence, there occurs a variation in the degree of dispersion (primary breakup), e.g., in the size of the liquid droplets, thus posing a problem in that the particle size distribution of the finally obtained metal powder is scattered over a broad range.

Furthermore, due to the fact that the air introduced into the flow path makes contact with the free-falling molten metal, the molten metal is solidified by temperature reduction and degenerated or degraded by oxidation in an expedited manner, which poses another problem in that a part of the solidified metal adheres to the ejection port.

Thus, a need arises to employ the ejection port 23 of a somewhat greater size, particularly when the molten metal contains highly active metal elements such as Ti and Al. In that case, the particle size of the resultant metal powder is also increased in proportion to the size of the ejection port 23, thereby making it difficult to obtain metal powder of a fine size and a high quality.

In the present invention, the tubular member 10 is provided between the supply part 2 and the first flow path 31 of the nozzle 3. The tubular member 10 serves to lead the molten metal Q, which is ejected from the ejection port 23, into the first flow path 31 through the inside (bore) thereof.

Owing to its ability to shield the molten metal Q against the stream of the air G, the tubular member 10 is capable of leading the molten metal Q to an appropriate target position, whereby the molten metal Q can be reliably subjected to the primary breakup in the primary breakup position. Thus, the molten metal Q is reliably dispersed by depressurization, thereby producing fine metal powder R with a uniform particle size.

Furthermore, since the molten metal Q is shielded from the stream of the air G, it is possible to suppress solidification of the molten metal Q caused by temperature reduction and degeneration or degradation of the molten metal Q caused by oxidation. Therefore, the metal powder production apparatus 1 is able to easily produce metal powder R even if they contain metal elements of high activity.

Moreover, thanks to such an advantageous effect, even when the size of the ejection port 23 is made small to reduce the ejection amount of the molten metal Q, it is still possible to suppress solidification of the molten metal Q caused by temperature reduction and degeneration or degradation of the molten metal Q caused by oxidation, thus allowing the molten metal Q to be ejected in a reliable manner.

In addition, reduction in the ejection amount of the molten metal Q allows fine liquid droplets Q1 to be formed with a size proportionate to the ejection amount, eventually making it possible to obtain finer metal powder R.

The metal powder R produced by means of the metal powder production apparatus 1 has an average particle size preferably in the range of about 1 to 20 μm and more preferably in the range of about 1 to 10 μm. The present metal powder production apparatus can be advantageously utilized in producing such fine metal powder R.

In the present embodiment, the tubular member 10 is of an elongated configuration and has a bottom-walled tubular shape as illustrated in FIG. 3. The tubular member 10, which is provided between the supply part 2 and the first flow path 31, has a single opening 11 on its top end side and a plurality of small diameter apertures 12 on its bottom wall.

By virtue of the apertures 12, the molten metal Q flowing through the tubular member 10 is split into a plurality of metal streams. This allows the molten metal Q to be broken up into finer liquid droplets Q1 during the primary breakup. That is to say, the plurality of apertures 12 function as a split means for substantially equally splitting the molten metal Q in a circumferential direction of the tubular member 10 (in a divergent manner).

From this point of view, it is preferred that the apertures 12 are formed in the bottom wall (bottom portion) of the tubular member 10 so as to be uniformly distributed in the bottom wall. This ensures that the molten metal Q is split into metal streams of a small and uniform size prior to being subjected to the primary breakup, which makes it possible to obtain finer liquid droplets Q1 of a narrow particle size distribution during the primary breakup.

The inner diameter of each of the apertures 12 is not particularly limited but may be preferably in the range of about 1 to 10 mm and more preferably in the range of about 1 to 5 mm. If the inner diameter of each of the apertures 12 falls within the above range, it becomes possible to form fine liquid droplets Q1 while preventing the apertures 12 from being clogged by a solidified material of the molten metal Q or by virtue of a surface tension of the molten metal Q.

As shown in FIG. 1, the tubular member 10 is arranged in such a fashion that it can be concentric with the ejection port 23 and coincident with the center axis O of the first flow path 31. Furthermore, the top end of the tubular member 10 remains in contact with the bottom portion 21 of the supply part 2 as depicted in FIG. 3.

This makes it possible to cut off the air G which would otherwise be sucked up and introduced into the tubular member 10 at the top end thereof by the falling molten metal Q. As a result, it becomes possible to suppress the afore-mentioned adverse effects (such as fluctuation of the flowing route, temperature reduction and oxidation of the molten metal Q) which would be caused by contact of the molten metal Q with the air G.

On the other hand, the bottom end of the tubular member 10 is arranged to lie around the midway of the first flow path 31. This ensures that the molten metal Q is supplied through the inside of the tubular member 10 up to near the smallest inner diameter section 331 where depressurization occurs most severely. As a consequence, it is possible to reliably prevent or suppress the adverse effects which would be caused by contact of the molten metal Q with the air G.

In this connection, it is preferred that the bottom end of the tubular member 10 lies in the vicinity of the primary breakup position. This makes sure that the molten metal Q undergoes the primary breakup upon ejection from the bottom end of the tubular member 10. Consequently, ultra fine liquid droplets Q1 are obtained.

The primary breakup position tends to vary with the composition and viscosity of the molten metal Q as well as the shape and angle of the gradually reducing inner diameter portion 33 and the orifice 34 of the nozzle 3. Thus, it is desirable that the position of the bottom end of the tubular member 10 be adjusted dependent upon the primary breakup position.

Moreover, it is often the case that the primary breakup position is generally located in the most severely depressurized region of the first flow path 31 or in the vicinity thereof. Therefore, the primary breakup position in the present embodiment lies near the smallest inner diameter section 331.

Thus, in the present embodiment, due to the fact that the bottom end of the tubular member 10 is located in the vicinity of the smallest inner diameter section 331, the molten metal Q undergoes the primary breakup immediately after it is ejected from the tubular member 10. This allows the molten metal Q to be subjected to the primary breakup at a high temperature and a low viscosity, thereby making it possible to obtain even finer liquid droplets Q1 and, eventually, even finer metal powder R.

Furthermore, if the molten metal Q is of the composition that can become amorphous powder particles, it is possible to increase the cooling speed of the liquid droplets Q1 by reducing the size thereof. This makes it possible to more reliably maintain the atomic arrangement in the liquid state, thereby obtaining amorphous metal powder R with a higher degree of amorphousness.

It is also preferred that the tubular member 10 is air-tightly connected at its top end to the supply part 2. This makes it possible to more reliably prevent the air G from being introduced into the tubular member 10 at the top end of the latter.

Furthermore, the bottom end portion of the tubular member 10 is depressurized by the stream of the air G flowing below the tubular member 10. As a result, the molten metal Q is ejected in such a manner that it is sucked out of the apertures 12 of the tubular member 10, thereby preventing a solidified material from being adhered to the periphery of the apertures 12.

Although the dimensions of the tubular member 10 may be properly set depending on the size of the ejection port 23, namely, the outer diameter of a stream of the falling molten metal, the cross sectional area of the bore of the tubular member 10 is preferably in the range of about 1 to 400 $mm^2$ and more preferably in the range of about 5 to 80 $mm^2$. Use of the tubular member 10 having such a range of dimensions enables the present metal powder production apparatus to efficiently produce extremely fine metal powder R with a uniform particle size.

Although the supply part 2 and the tubular member 10 are kept in contact in the present embodiment, they may be spaced apart from each other.

Furthermore, the tubular member 10 is preferably of a cylindrical shape. This assures that, as the molten metal Q falls down from the bottom end surface of the tubular member 10, the liquid droplets Q1 are distributed in a horizontal direction so as to make contact with the fluid jet S1 of a generally conical shape without any unevenness. As a result, the fluid jet S1 enables the liquid droplets Q1 to be uniformly dispersed and cooled as a whole, thus producing metal powder R with a uniform particle size.

This also helps to prevent a possibility that the stream of the air G introduced into the first flow path 31 is unintentionally disturbed by the tubular member 10 and the falling route of the molten metal Q is changed resultantly.

Alternatively, the plurality of apertures 12 formed in the bottom wall of tubular member 10 may be reduced in number to a single one and the tubular member 10 may have a tubular shape with no bottom wall.

Figure 4:
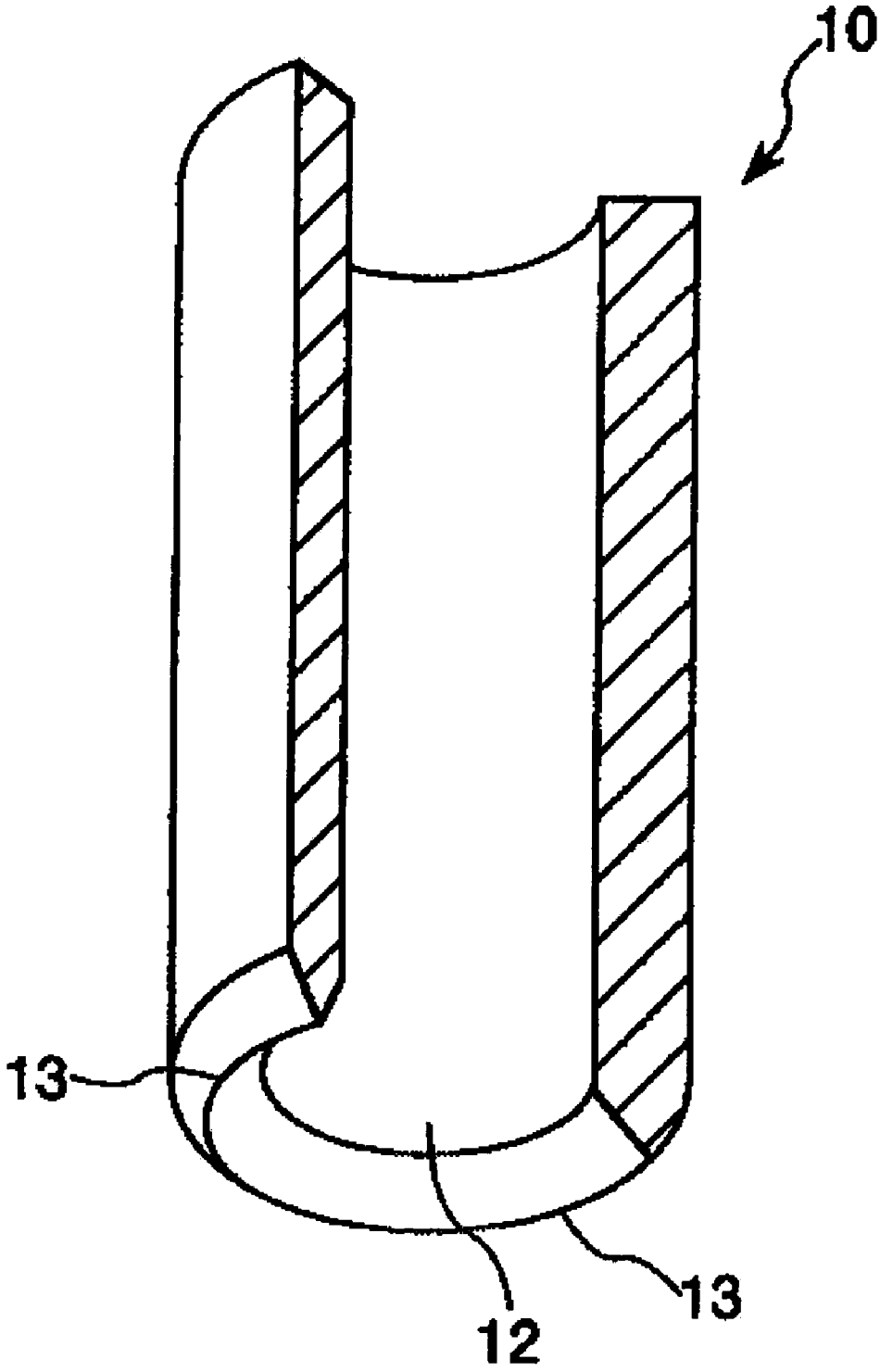
FIG. 4 is a partial sectional view schematically illustrating another exemplary configuration of a tubular member.
Figure 5:
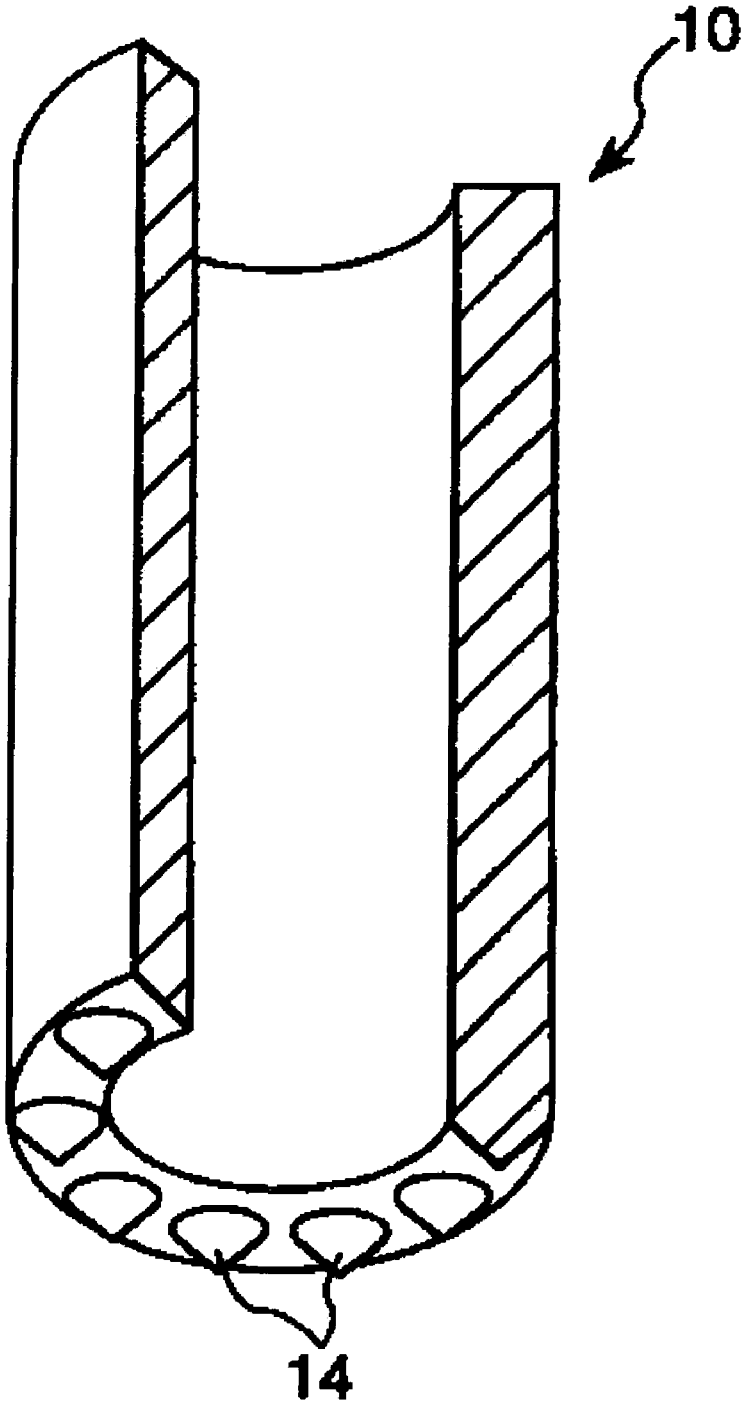
FIG. 5 is a partial sectional view schematically illustrating a further exemplary configuration of the tubular member.

FIGS. 4 and 5 are partial sectional views schematically illustrating other exemplary configurations of the tubular member.

The tubular member 10 illustrated in FIG. 4 has an annular protrusion 13 extending in a circumferential direction of the bottom end surface thereof. The protrusion 13 can be conveniently used as a split means that serves to substantially uniformly split the molten metal Q, which has passed the bore of the tubular member 10, in a circumferential direction of the tubular member 10 (in a divergent manner).

Use of the split means enables the liquid droplets Q1 to evenly fall down over the entirety of the first flow path 31, thereby allowing the liquid droplets Q1 to make substantially uniform contact with the conical fluid jet S1 and to be cooled and solidified with high cooling efficiency. This makes it possible to obtain homogeneous metal powder R in a more reliable manner.

By forming the protrusion 13 into such an annular shape as set forth above, the protrusion 13 serves as a split means capable of more uniformly splitting the molten metal Q. If the molten metal Q that has passed the tubular member 10 arrives at near a bottom opening 12 of the tubular member 10, it moves toward the inner wall of the tubular member 10 by virtue of the surface tension and flows down along the inner wall to reach the bottom end portion of the protrusion 13, while being split into the liquid droplets Q1.

As illustrated in FIG. 4, the protrusion 13 is sharp-edged at its lower end. This helps to reduce the contact area between the liquid droplets Q1 and the tubular member 10, thereby allowing the liquid droplets Q1 to be rapidly separated from the tubular member 10. As a result, it is possible to further shorten the time for which the liquid droplets Q1 stay on the surface of the tubular member 10, i.e., the time for which the liquid droplets Q1 make contact with the air G.

The tubular member 10 illustrated in FIG. 5 has a plurality of raised portions (protrusions) 14 arranged along the circumferential direction of the bottom end surface of the tubular member 10 at substantially equal intervals. This allows the raised portions 14 to function as a split means that substantially uniformly splits the molten metal Q, which has passed the bore of the tubular member 10, in a circumferential direction of the tubular member 10 (in a divergent manner). This provides the same advantageous effects as offered by the protrusion 13 set forth above.

By forming the raised portions 14 in plural numbers along the circumferential direction of the bottom end surface of the tubular member 10, it becomes easy to form the liquid droplets Q1 along the circumferential direction of the bottom end surface (bottom end portion) of the tubular member 10 at substantially equal intervals with no likelihood of the liquid droplets Q1 being concentrated on a local area of the bottom end surface, even if the axis of the tubular member 10 remains slightly inclined with respect to a vertical direction for example. This allows the liquid droplets Q1 to uniformly fall down over the entirety of the first flow path 31.

Other examples of the split means include slots or projections formed on the inner circumferential surface of the tubular member 10 in parallel with the axis thereof. The split means of this construction can provide the advantageous effects described above.

The tubular member 10 may be made of any material insofar as it exhibits a heat resistance great enough not to suffer from degeneration or degradation when contacted with the molten metal Q. Examples of a constituent material of the tubular member 10 include various ceramics materials such as alumina and zirconia and various heat-resistant metallic materials such as tungsten.

Among them, the ceramics materials are especially preferable for use as a constituent material of the tubular member 10. The reason is that the ceramics materials are particularly high in heat resistance and less likely to undergo chemical changes such as oxidation. Furthermore, the ceramics materials show a relatively high thermal insulation property (a relatively low heat conductivity), which provides an advantage of suppressing the temperature reduction of the molten metal Q.

In the present embodiment, an instance where the water S is used as the fluid has been described representatively. The fluid may be any type of liquid or gas coolant but it is preferred to use a liquid fluid as in the present embodiment. The liquid fluid has a specific gravity and a heat capacity greater than those of the gas fluid and is therefore capable of making the molten metal Q finer and efficiently cooling the same within a short period of time when contacted with the molten metal Q (in the secondary breakup process).

Furthermore, the liquid fluid tends to suck up a larger quantity of air G, which means that the liquid fluid can reduce the pressure (barometric pressure) of the first flow path 31 to a lower level and further facilitate pulverization of the molten metal Q in the primary breakup process.

The molten metal Q may contain any kind of element and even a metallic material containing, e.g., at least one of Ti and Al may be used as the molten metal Q. These elements are highly active and it is a conventional knowledge that the molten metal Q containing these elements has a difficulty in pulverization because of its tendency to be easily oxidized into an oxide film through short contact with the air G. The present metal powder production apparatus is able to easily powderize even such kind of molten metal Q.

Use of the metal powder production apparatus 1 described hereinabove makes it possible to efficiently produce fine metal powder R with a uniform particle size.

In the case where the metal powder R of such a high quality is used as, e.g., an abrasive material for grinding the surface of a workpiece, it is ensured that, when the abrasive material, i.e., the metal powder of the present invention, is injected against the workpiece, the kinetic energy of the respective particles becomes nearly equal so that a grinding operation can be performed with a uniform grinding force proportional to the kinetic energy. This allows the workpiece to be machined with high machining accuracy.

Furthermore, if the metal powder of the present invention is used as, e.g., raw powder for forming a compact, it is possible to prevent occurrence of formation defects such as a void and to obtain a compact having a high density. It is also possible to produce a sintered body of high dimensional accuracy by baking the compact thus obtained.

Second Embodiment

Next, description will be made on a metal powder production apparatus in accordance with a second embodiment of the present invention.

Figure 6:
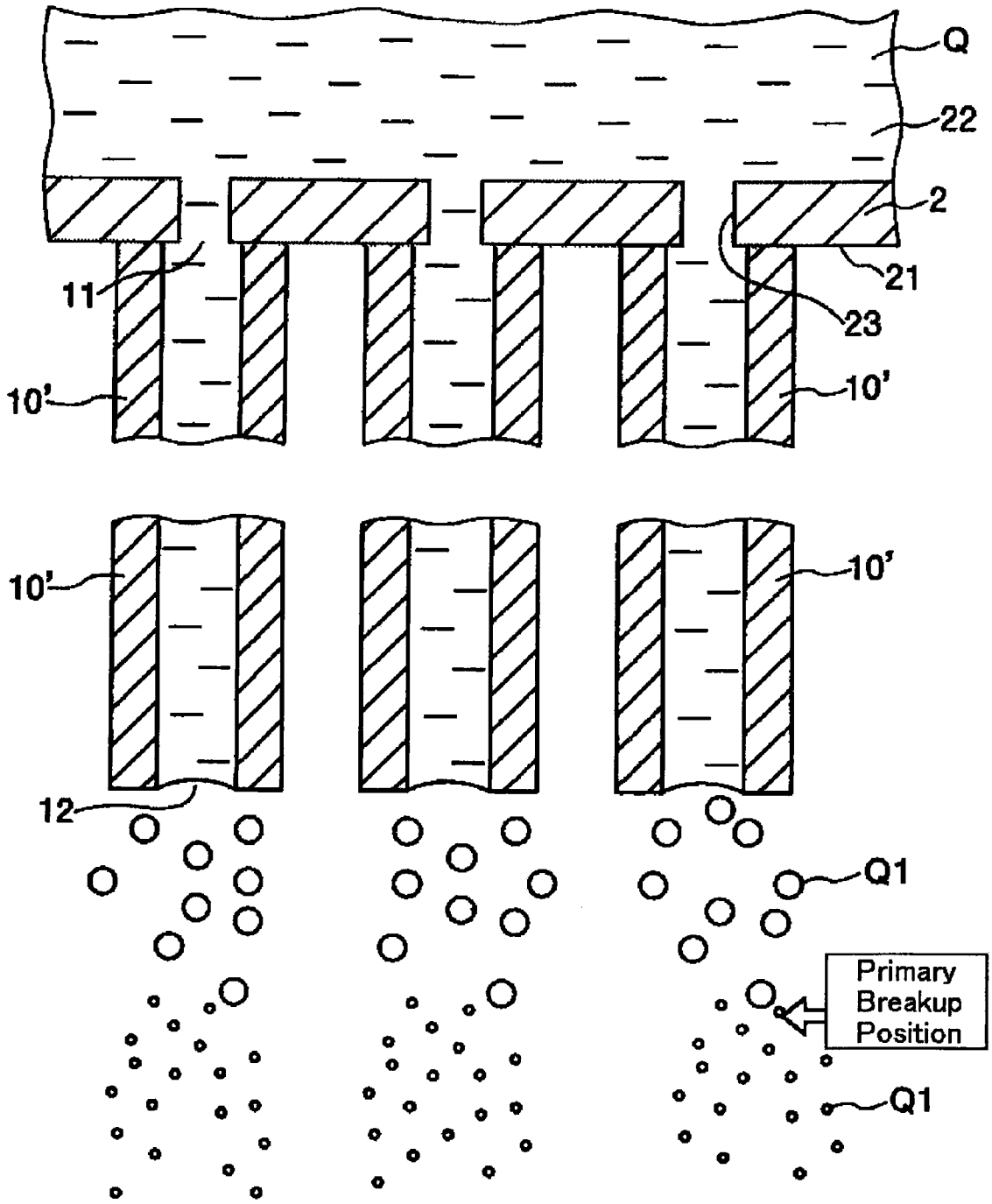
FIG. 6 is an enlarged detail view (schematic view) showing some parts of a metal powder production apparatus in accordance with a second embodiment of the present invention.

FIG. 6 is an enlarged detail view (schematic view) showing some parts of the metal powder production apparatus in accordance with the second embodiment of the present invention. In the following description, the upper side in FIG. 6 will be referred to as "top" or "upper" and the lower side will be referred to as "bottom" or "lower", only for the sake of better understanding.

The following description of the second embodiment will be centered on the points differing from the first embodiment, with the same points omitted from description.

The metal powder production apparatus 1 of the present embodiment is the same as that of the first embodiment, except that the tubular member has a differing configuration.

As shown in FIG. 6, a plurality of tubular members 10' are provided in the present embodiment. Just like the first embodiment described above, each of the tubular members 10' is arranged in such a manner that it can make contact with the bottom portion of the supply part 2 at its top end, while lying around the midway of the first flow path 31 at its bottom end.

Use of such a construction by which the molten metal Q is led to the first flow path 31 through the plurality of tubular members 10' allows the molten metal Q to be more broadly dispersed. This helps to diminish the probability that the liquid droplets Q1 thus formed are contacted with and bonded to one another, thus suppressing or preventing growth of the particle size of the liquid droplets Q1.

Each of the tubular members 10' may take the same configuration as that of the tubular member 10 employed in the first embodiment.

Third Embodiment

Next, description will be made on a metal powder production apparatus in accordance with a third embodiment of the present invention.

Figure 7:
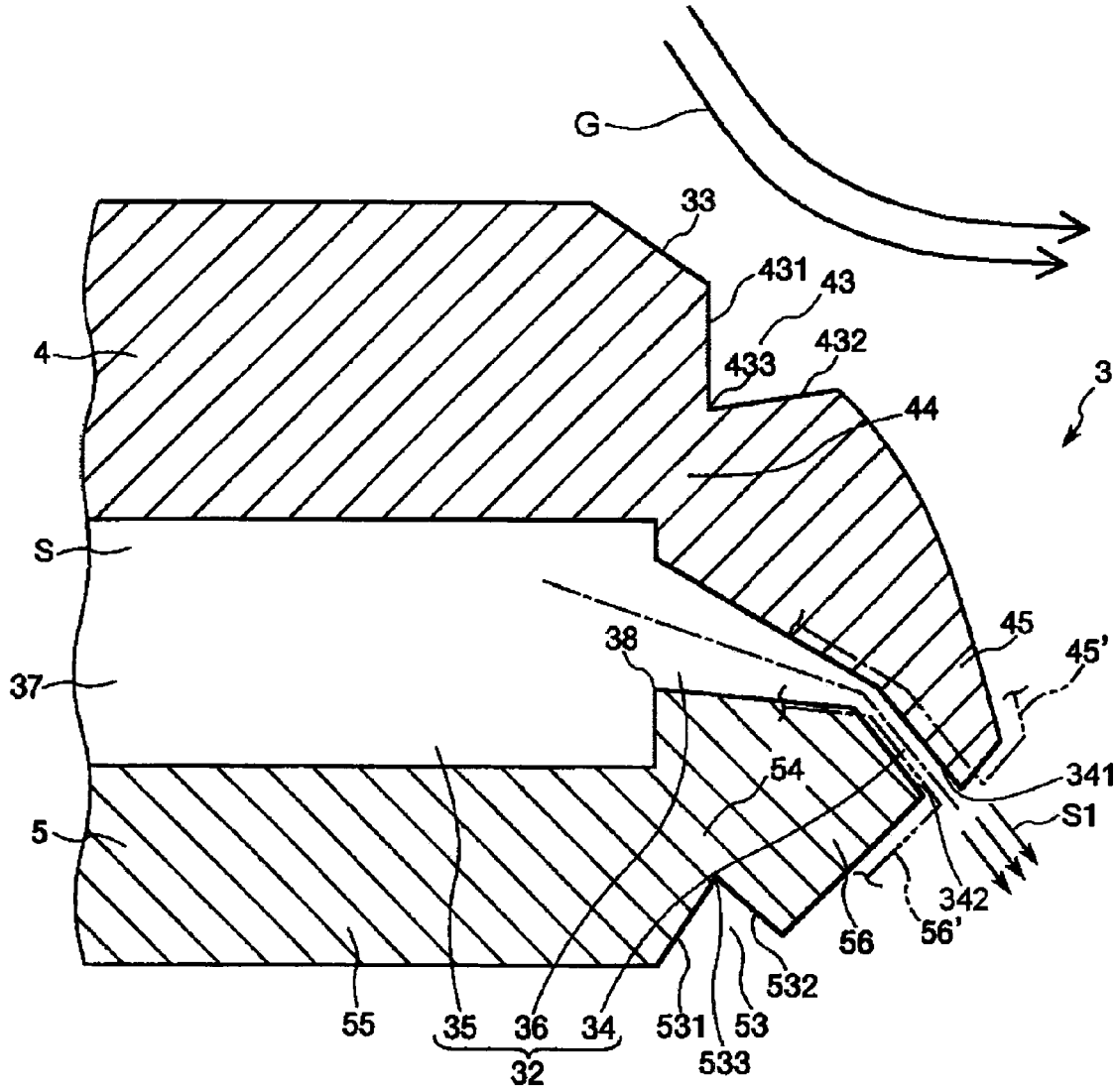
FIG. 7 is an enlarged detail view (schematic view) showing some parts of a metal powder production apparatus in accordance with a third embodiment of the present invention.

FIG. 7 is an enlarged detail view (schematic view) showing some parts of the metal powder production apparatus in accordance with the third embodiment of the present invention. In the following description, the upper side in FIG. 7 will be referred to as "top" or "upper" and the lower side will be referred to as "bottom" or "lower", only for the sake of better understanding.

The following description of the third embodiment will be centered on the points differing from the first embodiment, with the same points omitted from description.

The metal powder production apparatus 1 of the present embodiment is the same as that of the first embodiment, except for differences in the configuration of the first member and the second member.

As can be seen in FIG. 7, a first recess portion 43 and a first easy-to-deform portion 44 are formed in the first member 4. Likewise, a second recess portion 53 and a second easy-to-deform portion 54 are formed in the second member 5.

The first recess portion 43 is formed by cutting away a part of the gradually reducing inner diameter portion 33. Formation of the first recess portion 43 reduces the thickness of the first member 4. The thickness-reduced portion exhibits a low physical strength and becomes easily deformable, thus serving as the first easy-to-deform portion 44.

Owing to the fact that the first easy-to-deform portion 44 is easily deformable as noted above, the first central portion 45 lying closer to the center axis O of the first flow path 31 (more rightward in FIG. 7) than the first easy-to-deform portion 44 can be easily and reliably displaced about the first easy-to-deform portion 44. As one example of such displacement, the first central portion 45' that has been subjected to displacement is indicated by a double-dotted chain line in FIG. 7.

The first recess portion 43 is formed into an annular shape over the entire circumference of the gradually reducing inner diameter portion 33. This means that the first easy-to-deform portion 44 is formed to extend in the circumferential direction of the gradually reducing inner diameter portion 33, whereby the first central portion 45 can be uniformly displaced in each and every circumferential portion thereof.

As shown in FIG. 7, the first recess portion 43 is located inwardly (on the side of the center axis O), i.e., on the right side in FIG. 7, with respect to the boundary 38 between the retention portion 35 and the introduction path 36

The first recess portion 43 is formed to have a triangular cross-sectional shape. This allows two slopes 431 and 432 of the first recess portion 43 to be deformed in such a direction as to move toward each other. That is to say, the first easy-to-deform portion 44 can be deformed to reduce the apex angle of an apex portion 433 of the first recess portion 43, thereby allowing the first central portion 45 to be displaced easily and reliably.

Although the first recess portion 43 is located inwardly with respect to the boundary 38 in the illustrated construction, this imposes no limitation on the present invention. Alternatively, the first recess portion 43 may be located on the outer side of the boundary 38.

Furthermore, although the first recess portion 43 has a triangular cross-sectional shape in the illustrated construction, this imposes no limitation on the present invention. Alternatively, the first recess portion 43 may have, e.g., a "U"-shaped cross section.

The second recess portion 53 is formed by cutting away a part of the bottom portion 55 of the second member 5 adjacent to the orifice 34. Formation of the second recess portion 53 reduces the thickness of the second member 5. The thickness-reduced portion exhibits a low physical strength and becomes easily deformable, thus serving as the second easy-to-deform portion 54.

Owing to the fact that the second easy-to-deform portion 54 is easily deformable as noted above, the second central portion 56 lying closer to the center axis O of the first flow path 31 than the second easy-to-deform portion 54 can be displaced to follow the displacement of the first central portion 45'. As one example of such displacement, the second central portion 56' that has been subjected to displacement is indicated by a double-dotted chain line in FIG. 7.

The second recess portion 53 is formed into an annular shape along the circumferential direction of the gradually reducing inner diameter portion 33. This means that the second easy-to-deform portion 54 is formed to extend in the circumferential direction of the gradually reducing inner diameter portion 33, whereby the second central portion 56 can be uniformly displaced in each and every circumferential portion thereof.

As shown in FIG. 7, the second recess portion 53 is located inwardly, i.e., on the right side in FIG. 7, with respect to the boundary 38.

The second recess portion 53 is formed to have a triangular cross-sectional shape. This allows two slopes 531 and 532 of the second recess portion 53 to be deformed in such a direction as to move away from each other. That is to say, the second easy-to-deform portion 54 can be deformed to increase the apex angle of an apex portion 533 of the second recess portion 53, thereby allowing the second central portion 56 to be displaced easily and reliably.

Although the second recess portion 53 is located inwardly with respect to the boundary 38 in the illustrated construction, this imposes no limitation on the present invention. Alternatively, the second recess portion 53 may be located on the outer side of the boundary 38.

Furthermore, although the second recess portion 53 has a triangular cross-sectional shape in the illustrated construction, this imposes no limitation on the present invention. Alternatively, the second recess portion 53 may have, e.g., a "U"-shaped cross section.

With the metal powder production apparatus 1 of the construction described above, as the fluid jet S1 is ejected from the orifice 34, the inner circumferential surface 341 and the outer circumferential surface 342 are pressed by the pressure of the water S passing through the orifice 34. Thus, the orifice 34 tends to be enlarged.

Nevertheless, the metal powder production apparatus 1 shown in FIG. 7 ensures that, as the fluid jet S1 is ejected from the orifice 34, the first central portion 45 is displaced about the first easy-to-deform portion 44 under the pressure of the water S passing through the vicinity of the boundary 38, the introduction path 36 and the orifice 34, thus assuming the position designated by reference numeral 45' in FIG. 7.

As with the first central portion 45, the second central portion 56 is displaced by the pressure of the water S to follow the first central portion 45' (the first central portion 45 as displaced), thus assuming the position designated by reference numeral 56'.

In this way, the metal powder production apparatus 1 shown in FIG. 7 is adapted to ensure that the first central portion 45 and the second central portion 56 are respectively displaced (deformed) in the same direction, consequently restricting enlargement of the diameter (gap) of the orifice 34.

This makes it possible to keep the size of the orifice 34 constant, whereby the flow velocity of the fluid jet S1 injected from the orifice 34 can be maintained constant in a reliable manner. As a result, independently of the pressure of the water S, it is possible to maintain the flow velocity of the fluid jet S1 constant, thus keeping constant the capability of the fluid jet S1 to cool the liquid droplets Q1.

Furthermore, with the metal powder production apparatus 1 shown in FIG. 7, the stream of the air G sucked up into the gradually reducing inner diameter portion 33 is disturbed by the first recess portion 43 formed around the midway of the gradually reducing inner diameter portion 33 and is directed toward the tubular member 10. The stream of the air G directed toward the tubular member 10 flows downwardly along the outer circumferential surface of the tubular member 10.

Accordingly, in the bottom end portion of the tubular member 10, the stream of the air G passes through a region closer to the tubular member 10, thereby further promoting the pressure reduction in the vicinity of the bottom end portion of the tubular member 10. This helps to suck out the molten metal Q from the inside of the tubular member 10, thus assuring reliable ejection of the molten metal Q.

Moreover, since the primary breakup position lies nearer to the bottom end portion of the tubular member 10, the molten metal Q is allowed to undergo the primary breakup at a high temperature and with a low viscosity. This makes it possible to obtain finer liquid droplets Q1 and, eventually, finer metal powder R.

Furthermore, if the molten metal Q is of the composition that can become amorphous powder particles, it is possible to increase the cooling speed of the liquid droplets Q1 by reducing the size thereof. This makes it possible to more reliably maintain the atomic arrangement in the liquid state, thereby obtaining amorphous metal powder R with a higher degree of amorphousness.

While the metal powder production apparatus and the metal powder of the present invention have been described hereinabove in respect of the illustrated embodiments, the present invention is not limited thereto. For example, individual parts constituting the metal powder production apparatus may be substituted by other arbitrary ones capable of performing like functions. Arbitrary constituent parts may be added if necessary. In addition, the tubular member may be constructed by, e.g., combining the plurality of configurations described above in connection with the foregoing embodiments.

EXAMPLES

1. Production of Metal Powder

Example 1

First, a molten material was obtained by melting Cu (copper) in a high-frequency induction furnace.

Next, the molten material thus obtained was pulverized into copper powder (metal powder) by means of the atomizer (the present metal powder production apparatus) shown in FIG. 1.

In the atomizer shown in FIG. 1, an alumina-made cylindrical member (the tubular member) was arranged such that its top end was air-tightly connected to a tundish (the supply part) and its bottom end lay around the midway of a flow path (the first flow path) through which the molten metal passes.

The cylindrical member used has an inner diameter of 5 mm (a cross-sectional area of 19.6 $mm^2$). Water was used as fluid for cooling the molten metal.

Example 2

Copper powder was obtained in the same manner as in Example 1, except that the cylindrical member used has an inner diameter of 6 mm (a cross-sectional area of 28.3 $mm^2$).

Comparative Example

Copper powder was obtained in the same manner as in Example 1, except for use of the atomizer having no cylindrical member.

2. Evaluation of Metal Powder

For the copper powder obtained in the respective Examples and the Comparative Example, average particle sizes and standard deviations of particle size distribution were evaluated by a laser type particle size distribution meter. Table 1 shows the results of evaluation.

TABLE 1

| | Inner Diameter | Results of Evaluation | |
|---|---|---|---|
| | Of Cylindrical Member (mm) | Average Particle Size (μm) | Standard Deviation of Particle Size Distribution |
| Example 1 | 5 | 5.2 | 2.09 |
| Example 2 | 6 | 6.0 | 2.30 |
| Com. Example | — | 7.7 | 2.55 |

As shown in Table 1, it can be recognized that the copper powder of the respective Examples has a small and uniform particle size as compared to the copper powder of the Comparative Example. Such a tendency is particularly conspicuous in the case of the copper powder obtained in Example 1.

In this regard, in place of Cu powder, each of Cu—Ti alloy (Cu:Ti=99:1 by weight) powder, Cu—Al alloy (Cu:Al=97:3 by weight) powder and Cu—Ti—Al alloy (Cu:Ti:Al=98:1:1 by weight) powder was manufactured in the same manner as in the respective Examples and the Comparative Example to carry out the same evaluation test as that described above. The evaluation results were substantially the same as those of the respective Examples and the Comparative Example.

What is claimed is:

1. A metal powder production apparatus comprising:

a supply part for supplying molten metal; and a nozzle provided below the supply part, the nozzle including a flow path defined by an inner circumferential surface of the nozzle through which the molten metal supplied from the supply part can pass and having a bottom end portion and an orifice opened toward the bottom end portion of the flow path for injecting fluid into the flow path, whereby the molten metal can be dispersed and turned to a multiplicity of fine liquid droplets by bringing the molten metal passing through the flow path into contact with the fluid injected from the orifice of the nozzle so that the multiplicity of fine liquid droplets are cooled and solidified to thereby produce metal powder, wherein the metal powder production apparatus further comprises a tubular member provided between the supply part and the flow path of the nozzle, the tubular member having a top end, a bottom end and a bore through which the molten metal supplied from the supply part passes to make contact with the fluid, wherein the tubular member is arranged such that the bottom end of the tubular member lies around the midway of the flow path and such that the tubular member is not in contact with the inner circumferential surface of the nozzle.

2. The metal powder production apparatus as claimed in claim 1, wherein the flow path has a portion whose inner diameter defined by the inner circumferential surface of the nozzle is continuously decreased in a downward direction.

3. The metal powder production apparatus as claimed in claim 2, wherein the flow path has the smallest inner diameter portion and the tubular member is arranged such that the bottom end of the tubular member lies near the smallest inner diameter portion of the flow path.

4. The metal powder production apparatus as claimed in claim 1, wherein the top end of the tubular member makes contact with the supply part.

5. The metal powder production apparatus as claimed in claim 4, wherein the top end of the tubular member air-tightly connects to the supply part.

6. The metal powder production apparatus as claimed in claim 1, wherein the bore of the tubular member has a cross-sectional area of 1 to 400 $mm^2$.

7. The metal powder production apparatus as claimed in claim 1, wherein the tubular member has a generally cylindrical shape.

8. The metal powder production apparatus as claimed in claim 1, wherein the tubular member is made of a ceramics material.

9. The metal powder production apparatus as claimed in claim 2, wherein the nozzle includes a first member and a second member arranged below the first member with a space left therebetween to form the orifice, the first member having a recess portion which is formed in an annular shape corresponding to the portion of the flow path along the circumferential direction thereof and by which an air stream, which is produced in the flow path under the action of the fluid injected from the orifice of the nozzle, is disturbed and directed toward the tubular member.

* * * * *